United States Patent [19]

Braun

[11] 4,346,938

[45] Aug. 31, 1982

[54] HAULING AND CUTTING PLANT

[75] Inventor: Ernst Braun, Essen-Heisingen, Fed. Rep. of Germany

[73] Assignee: Halbach & Braun, Fed. Rep. of Germany

[21] Appl. No.: 184,748

[22] Filed: Sep. 8, 1980

[30] Foreign Application Priority Data

Sep. 22, 1979 [DE] Fed. Rep. of Germany ..... 2938446

[51] Int. Cl.[3] ..... E21C 29/16

[52] U.S. Cl. ..... 299/43; 474/165; 474/903

[58] Field of Search ..... 299/32, 34, 43, 50; 474/165, 903; 308/15, 18, 237 A

[56] References Cited

U.S. PATENT DOCUMENTS

| | | | |
|---|---|---|---|
| 2,810,565 | 10/1957 | Dommann | 299/34 |
| 3,766,792 | 10/1973 | Braun et al. | 474/165 X |
| 3,809,431 | 5/1974 | Nakajima | 299/34 |

FOREIGN PATENT DOCUMENTS

| | | | |
|---|---|---|---|
| 956573 | 1/1957 | Fed. Rep. of Germany | 299/34 |

*Primary Examiner*—Ernest R. Purser
*Attorney, Agent, or Firm*—John J. McGlew

[57] ABSTRACT

A hauling and cutting assembly of the type having a conveyor trough and a scraper chain conveyor bridging the conveyor trough includes a roller member radially mounted for rotation on the end of a bearing pin which supports a sprocket wheel and a guide member operatively connected to the conveyor trough overlaps the roller member to provide radial support therefor.

10 Claims, 3 Drawing Figures

HAULING AND CUTTING PLANT

FIELD AND BACKGROUND OF THE INVENTION

The invention relates, in general, to a hauling and cutting unit of the type having a cutting machine or a similar mining machine bridging a conveyor trough, in the manner of a gantry and more particularly, the invention relates to an improved hauling and cutting assembly with a chain scraper conveyor having a drive, arranged at the backfilling end, and at least one chain sprocket wheel mounted on a bearing pin and engaging a drive chain extending in the direction of conveyance within the guide slot of a base frame that is connected to the backfilling end to the trough wall of the conveyor.

In such hauling and cutting units, high power must be transmitted from the drive to the cutting machine. This power transmission leads to extremely high stresses on a chain wheel which engages the drive chain. Due to the radial forces with the resulting tilting moments, such chain wheels tend to be forced out of engagement with the driving chain. A safe drive of the cutting machine requires, however, proper engagement of the chain wheels with the driving chain.

SUMMARY OF THE INVENTION

It is an object of the invention to provide a hauling and cutting unit of the type described, in which proper engagement of the chain wheel with the drive chain is always assured, even at extremely high driving loads.

In accordance with the invention, in a hauling and cutting unit of the type described, a bearing pin on which the chain wheel is mounted, is provided at its outer end with a roller. The unit has base frame with a guide flange, overlapping the roller, with a roller bearing surface on its underside that serves as an upper abutment for radial roller support. According to the invention, the bearing pin for the chain wheel bears, by means of the roller, against the underside of a guide flange, which serves as an upper abutment to absorb the upwardly directed radial forces acting on the chain wheel. This positively prevents the chain wheel from being forced out, and also from being lifted, so that proper driving conditions are always assured even though extremely high loads are transmitted by the drive.

In accordance with a feature of the invention, the roller can be designed as a sealed roller bearing arranged on the bearing pin, whose outer race forms a roller jacket and whose inner race is formed by the bearing pin. It is also possible, in accordance with the invention, to design the roller as a sliding bearing, arranged on the bearing pin, which has a sliding ring secured on the bearing pin and a roller jacket revolving on the sliding ring. In both cases, rolling friction is achieved between roller jacket and guide flange, to insure that the chain wheel, and thus of the entire drive, is easily held down. Preferably, the guide profile is screwed onto the base frame with the interposition of distance bushes, so that the bearing surface on the underside of the guide flange can always be brought to the bearing pin for the chain during the assembly in agreement with the roller.

According to another important feature of an embodiment of the invention, the chain wheel bearing with the bearing pin is covered, on its inside, by means of a bearing cap piece and, on the cap piece, there is arranged a hold down device. The hold down device comprises at least one roller, underlapping the slotted guide for the drive chain, bears against the underside of the slotted guide designed as a bearing surface. In this way, hold down is achieved at both sides of the chain wheel over rollers, where the slotted guide for the driving chain on the inside serves as an upper abutment for the respective roller and which absorbs the upwardly directed radial forces acting there. Preferably, several rollers forming holding down devices are provided and are surrounded in both directions of motion by broaching plates. With the roller for the bearing pin at the top, such a broaching plate is not necessary, because the possibility of contamination exists only with the lower rollers on the inside of the chain wheel, due to the small coal produced there.

Substantial advantages are achieved by the invention due to the fact that a hauling and cutting unit may be constructed that has a drive which operates safely even when transmitting high loads since the chain wheels can no longer be forced out of engagement with the drive chain, and that a proper engagement is always ensured. Moreover, since the holding down of the chain wheel is effected by means of rollers, a particularly easy support of the chain wheel is achieved. Beyond that, the holding down can be provided not only on the outer side, but also on the inner side of the chain wheel, so that roller support for the chain wheel exists on both sides, which is particularly advantageous when the hauling and cutting unit is used in inclined position.

Accordingly, it is an object of the invention to provide an improved hauling and cutting assembly of the type having a conveyor trough, a scraper chain conveyor bridging the conveyor trough, a bearing pin mounted on the conveyor, a sprocket wheel arranged on the bearing pin for rotation, a base frame connected to the conveyor trough having a portion with a guide slot longitudinally extending in the conveying direction, and a drive chain engaging the sprocket wheel extending within the guide slot, wherein the improvement includes a roller member radially mounted for rotation at the end of the bearing pin and guide means connected to the base frame overlapping the roller member for radially supporting the roller member. The guide means preferably includes a flange having bearing surfaces overlying and underlying the roller member.

In accordance with one embodiment of the invention, the roller member includes a roller bearing radially mounted on the bearing pin with an outer race radially overlying the bearing member for engagement with the guide means.

In another embodiment of the invention, the roller member includes a sliding bearing mounted on the bearing pin, a sliding ring mounted on the bearing pin, and a roller jacket rotatably mounted on the sliding ring. The guide means is preferably disposed at a spaced distance from the end of the bearing pin by bushes.

It is a further object of the invention to provide an improved hauling and cutting assembly which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
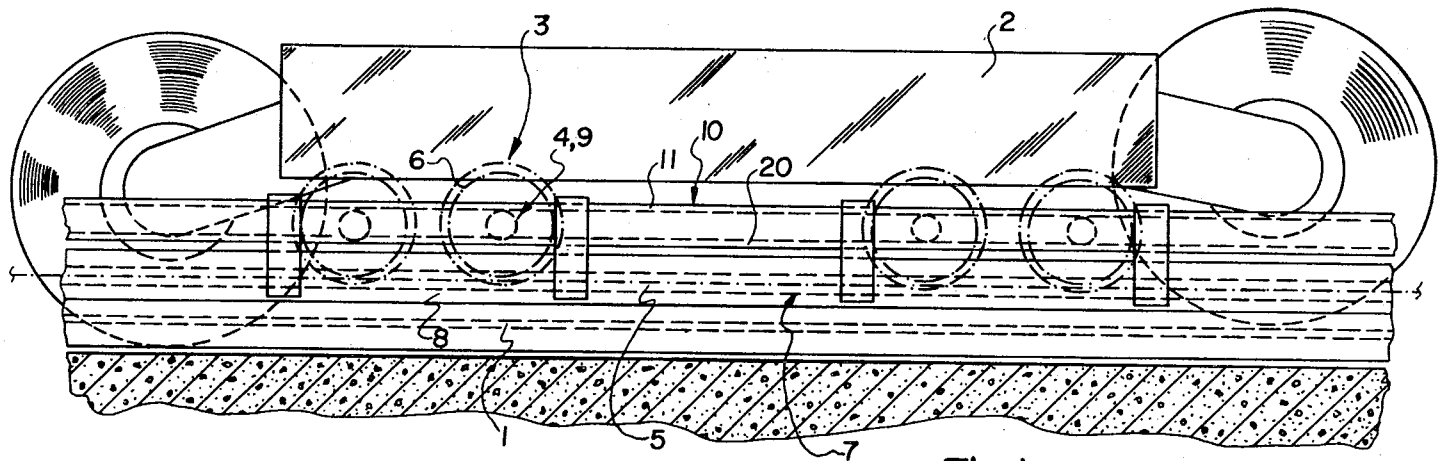
FIG. 1 is a schematic front view of a hauling and cutting plant according to the invention.
Figure 2:
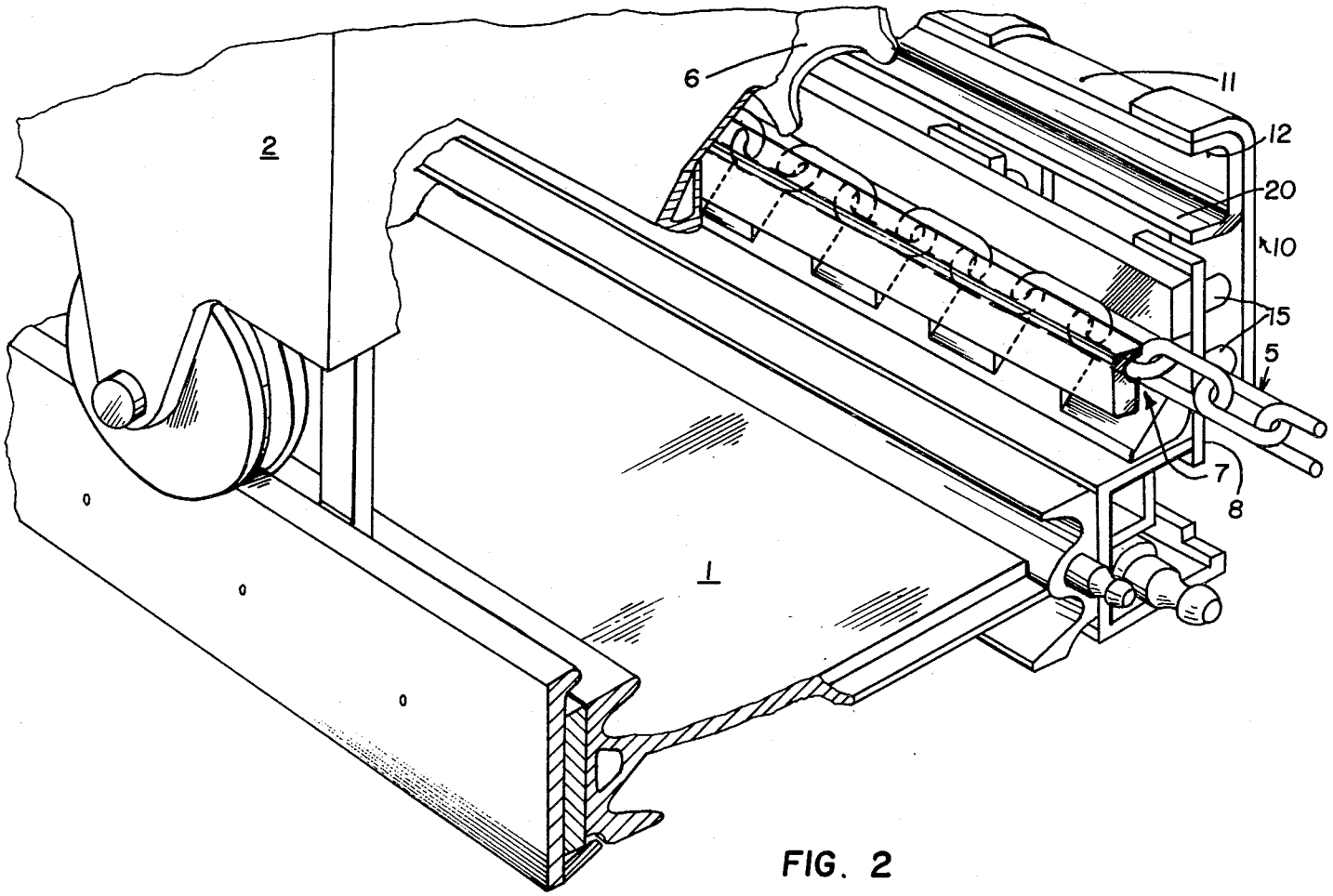
FIG. 2 shows a perspective top view of the arrangement according to FIG. 1.

Referring to the drawings, in particular, wherein like reference numerals designate similar or like parts throughout the several views, the figures show a hauling and cutting assembly with a cutting machine 2 or similar mining machine, in particular, a scraper chain conveyor in the manner of a gantry.

The cutting machine 2 comprises a drive 3 arranged at the backfilling end with at least one chain sprocket wheel 6, mounted on a bearing pin 4, that engages a drive chain 5. The drive chain 5 extends in the conveying direction, hence in the longitudinal direction of the conveyor, and is arranged within a slotted guide 7 of a base frame. The base frame is connected at the backfilling end to the trough wall of the conveyor. The bearing pin 4 for chain wheel 6 is provided with a roller 9 rotatably mounted to its outer end. The bearing pin 4, itself, can also be equipped or be designed as a roller The base frame 8 has a guide profile 10 with a guide flange 11 overlapping roller 9, with a bearing surface 12 on its underside for roller 9 serving as an upper abutment for radial roller support. Guide flange 11, serving as an upper abutment, thus absorbs the upwardly directed radial forces acting on chain wheel 6 when the drive is in operation.

Figure 3:
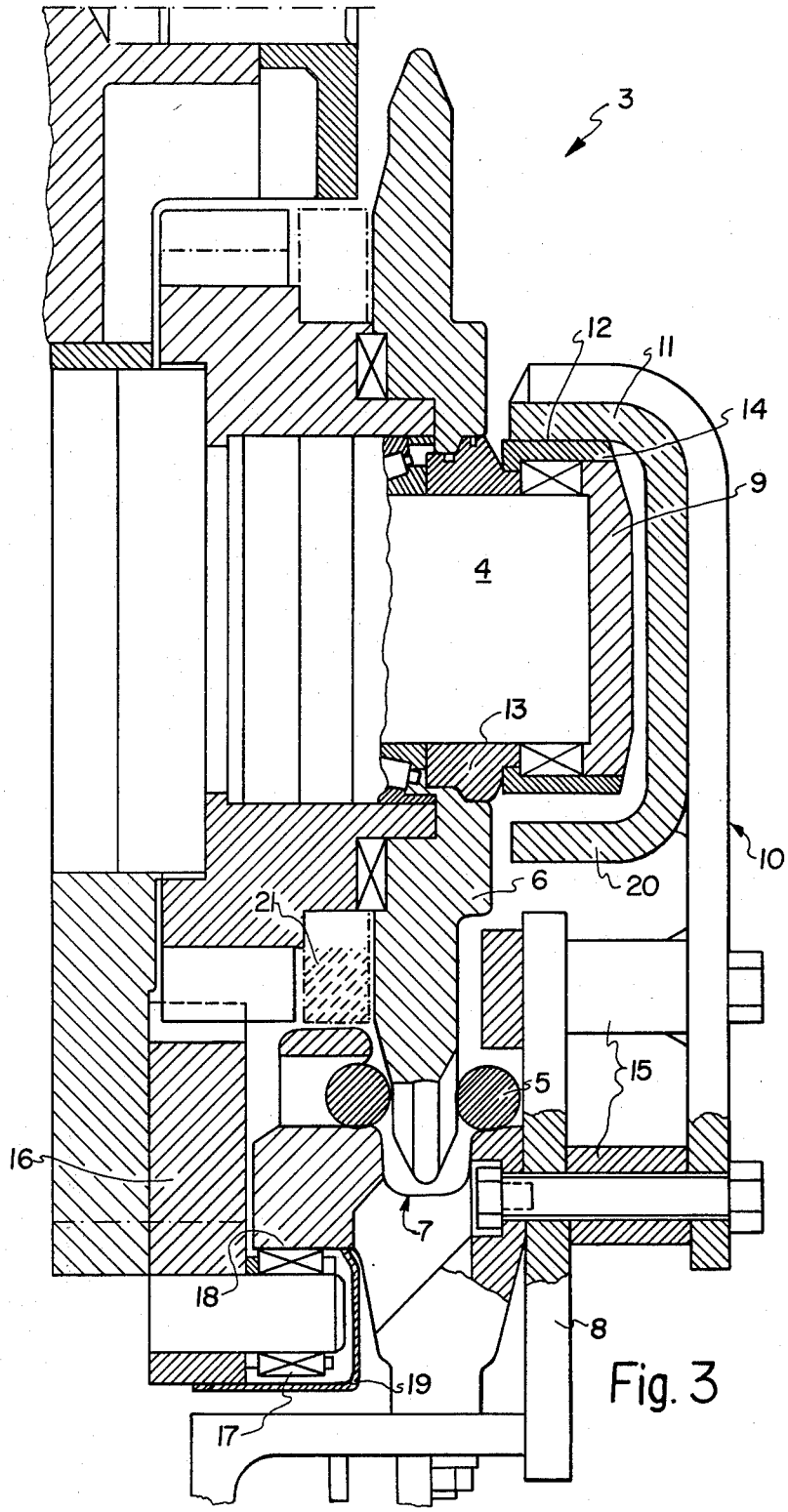
FIG. 3 illustrates an enlarged vertical section through of drive for the cutting machine in the vicinity of a chain wheel.

Roller 9 may be designed as a sealed roller bearing, arranged on bearing pin 4, having an outer race which forms a roller jacket and an inner race is the bearing pin. In FIG. 3, an embodiment of roller 9 is shown in which roller 9 is designed as a sealed sliding bearing, arranged on bearing pin 4, which has a sliding ring 13 secured on bearing pin 4 and a roller jacket 14 revolving on sliding ring 13.

Guide profile 10 can be screwed to base frame 8 and spaced therefrom through the interposition of distance bushes 15. The chain sprocket wheel, as well as bearing pin 4, is covered on at inside face, remote from the end of the bearing pin 4 on which the roller is mounted with a bearing and bearing cover plate 16. On cover plate 16 there is secured, as a holding-down device, at least one roller 17 underlapping the slotted guide 7 for the drive chain 5. The roller 17 bears against the underside of slotted guide 7 through a bearing surface 8. Slotted guide 7, therefore, serves as an upper abutment for the associated inside roller 17 and absorbs the upwardly directed radial forces acting there. As a rule, a pair of rollers 17 is provided. Roller 17, forming the holding-down device, are surrounded or shielded in both directions of motion by a broaching plate 19.

According to a preferred embodiment of the invention, which is of importance by itself, guide profile 10 has a bearing flange 20 underlapping roller 9. Due to this bearing flange 20, a supporting wheel 21 (shown in phantom) for the drive, which is otherwise associated with chain wheel 6, is not necessary. Rather with a corresponding penetration in the hub of chain sprocket wheel 6, permits roller 9 to bear on bearing flange 20 and to run thereon unless upwardly directed radial forces appear when the drive is in operation.

While specific embodiments of the invention have been shown and described in detail to illustrate the application of the principles of the invention, it will be understood that the invention may be embodied otherwise without departing from such principles.

What is claimed is:

1. An improved hauling and cutting assembly of the type having a conveyor trough, a scraper chain conveyor bridging the conveyor trough, a bearing pin mounted on the conveyor, a sprocket wheel arranged on the bearing pin, a base frame connected to the conveyor trough having a portion with a guide slot longitudinally extending in the conveying direction, and a drive chain engaging the sprocket wheel extending within the guide slot, wherein the improvement comprises a roller member radially mounted for rotation at the end of the bearing pin, and guide means connected to the base frame overlapping said roller member for radially supporting said roller member.

2. An improved hauling and cutting assembly as set forth in claim 1 wherein said guide means comprises a flange having bearing surfaces overlying and underlying said roller member.

3. An improved hauling and cutting assembly as set forth in claim 2 wherein said roller member comprises a roller bearing radially mounted on the bearing pin and an outer race radially overlying the bearing member for engagement with said guide means.

4. An improved hauling and cutting assembly as set forth in claim 1 wherein said roller member comprises a roller bearing radially mounted on the bearing pin and an outer race radially overlying the bearing member for engagement with said guide means.

5. An improved hauling and cutting assembly as set forth in claim 1, wherein said roller member comprises a sliding bearing mounted on the bearing pin, a sliding ring mounted on the bearing pin, and a roller jacket rotatably mounted on said sliding ring.

6. An improved hauling and cutting assembly as set forth in claim 1, wherein said guide means is disposed at a spaced distance from the end of the bearing pin.

7. An improved hauling and cutting assembly as set forth in claim 6 wherein said guide means comprises a flange having bearing surfaces overlying and underlying said roller member, and a bush disposed intermediate said flange and said base frame.

8. An improved hauling and cutting assembly as set forth in claim 1, further comprising a bearing mounted to the sprocket wheel at a side of the sprocket wheel remote to the end of the bearing pin, a bearing cap overlying said bearing, and roller means connected to said bearing cap in engagement the portion having the guide slot for providing a bearing for the portion.

9. An improved hauling and cutting assembly as set forth in claim 8 wherein said roller means includes bearing rollers, and a broaching plate mounted to said bearing cap intermediate said bearing rollers and said base frame.

10. An improved hauling and cutting assembly as set forth in claim 9 wherein said guide means comprises a flange having bearing surfaces overlying and underlying said roller member.

* * * * *